US010386090B2

(12) United States Patent
Fang

(10) Patent No.: US 10,386,090 B2
(45) Date of Patent: Aug. 20, 2019

(54) RECONFIGURABLE SYSTEM ALLOWING AIR FLOW THROUGH AN OPEN WINDOW WHILE BLOCKING PRECIPITATION

(76) Inventor: Zhihua Fang, Canton, MI (US)

( * ) Notice: Subject to any disclaimer, the term of this patent is extended or adjusted under 35 U.S.C. 154(b) by 931 days.

(21) Appl. No.: 12/836,574

(22) Filed: Jul. 14, 2010

(65) Prior Publication Data

US 2012/0015596 A1 Jan. 19, 2012

(51) Int. Cl.

| | |
|---|---|
| ***E06B 7/02*** | (2006.01) |
| ***F24F 13/08*** | (2006.01) |
| ***E06B 7/082*** | (2006.01) |
| *F24F 7/00* | (2006.01) |

(52) U.S. Cl.

CPC ..... *F24F 13/082* (2013.01); *E06B 7/082* (2013.01); *F24F 2007/003* (2013.01); *F24F 2221/52* (2013.01)

(58) Field of Classification Search

CPC ..... F24F 13/082; F24F 2007/003; F24F 2221/52; E06B 7/082

USPC ..... 454/220, 221, 222, 224, 200, 196, 195, 454/211, 905, 223, 212, 225; 52/473; 160/114

See application file for complete search history.

(56) References Cited

U.S. PATENT DOCUMENTS

| | | | | |
|---|---|---|---|---|
| 1,173,548 A | | 2/1916 | Beahan | |
| 1,529,711 A | | 3/1925 | Parrot et al. | |
| 1,798,540 A | | 3/1931 | Kelly | |
| 2,139,781 A | * | 12/1938 | Trammell | E06B 9/327 160/172 R |
| 2,155,985 A | * | 4/1939 | Waterman | E06B 9/305 160/176.1 R |
| 2,210,516 A | * | 8/1940 | Wheeler | 160/223 |
| 2,228,224 A | * | 1/1941 | Benson | 454/210 |
| 2,246,413 A | | 6/1941 | Jones | |
| 2,341,233 A | * | 2/1944 | Norton | E06B 9/386 160/236 |
| 2,487,108 A | | 11/1949 | DeCarlo | |
| 2,527,989 A | | 10/1950 | Fuller | |
| 2,633,191 A | * | 3/1953 | Curtis, Jr. | E06B 9/386 160/176.1 R |
| 2,741,973 A | | 4/1956 | Swor | |
| 2,779,402 A | * | 1/1957 | Canning | 160/102 |
| 3,008,403 A | * | 11/1961 | Van De Veire | 454/221 |
| 3,086,442 A | | 4/1963 | Waldron | |
| 3,151,714 A | * | 10/1964 | Kennedy | 52/473 |
| 3,287,870 A | | 11/1966 | Johnson | |
| 3,358,580 A | | 12/1967 | Freese et al. | |
| 3,628,442 A | * | 12/1971 | Nijhuis | 454/277 |
| 3,771,430 A | * | 11/1973 | Lane | 454/277 |
| 3,782,050 A | * | 1/1974 | Dowdell | F24F 13/08 454/277 |
| 3,991,533 A | * | 11/1976 | Nagase | 52/473 |
| 4,064,670 A | | 12/1977 | Lichtenwald | |
| 4,103,468 A | | 8/1978 | Olsen | |

(Continued)

*Primary Examiner* — Vivek K Shirsat

(74) *Attorney, Agent, or Firm* — Dinsmore & Shohl LLP

(57) ABSTRACT

This invention relates to two devices that are used to let fresh air in or through a window or opening but at the same time keep rain or any other kind of precipitation out. This is a device that will enable people to keep a window or an opening open even in inclement weather or when precipitation of any kind threatens to enter the opening or window. This is a device that will also save energy as it will significantly decrease the use of air conditioning in homes and offices.

12 Claims, 12 Drawing Sheets

(56) References Cited

U.S. PATENT DOCUMENTS

| | | | | | |
|---|---|---|---|---|---|
| 4,252,076 | A | | 2/1981 | Williams | |
| 4,263,842 | A | | 4/1981 | Moore | |
| 4,310,993 | A | | 1/1982 | White | |
| 4,365,930 | A | * | 12/1982 | Ogura et al. | 415/61 |
| 4,452,024 | A | | 6/1984 | Sterriker et al. | |
| 4,858,400 | A | * | 8/1989 | Foyt | 52/98 |
| 4,958,555 | A | | 9/1990 | Lentz et al. | |
| 5,334,091 | A | * | 8/1994 | Shih-Chin | 454/210 |
| 5,542,224 | A | | 8/1996 | Olsen | |
| 5,658,130 | A | * | 8/1997 | Goldstein | F04D 25/105 415/60 |
| 5,782,051 | A | | 7/1998 | LaVoie | |
| 6,196,292 | B1 | * | 3/2001 | Jackson | E06B 9/303 160/113 |
| 6,378,262 | B1 | * | 4/2002 | Mercadante | 52/473 |
| 6,658,793 | B2 | | 12/2003 | Perron | |
| 6,745,522 | B2 | | 6/2004 | Germain | |
| 6,923,250 | B2 | | 8/2005 | Hegg et al. | |
| 7,165,596 | B1 | | 1/2007 | Helton | |
| 2005/0252086 | A1 | | 11/2005 | Yorgason | |
| 2007/0144454 | A1 | | 6/2007 | Lee et al. | |
| 2007/0187042 | A1 | * | 8/2007 | Kallstrom | 160/7 |
| 2010/0099349 | A1 | | 4/2010 | Gohring et al. | |
| 2010/0332034 | A1 | * | 12/2010 | Bergeson et al. | 700/275 |
| 2011/0039490 | A1 | | 2/2011 | Wiese | |
| 2011/0093122 | A1 | | 4/2011 | Koumoudis | |
| 2011/0162808 | A1 | | 7/2011 | Castel | |
| 2012/0015596 | A1 | | 1/2012 | Fang | |
| 2012/0060802 | A1 | | 3/2012 | Livingston | |

* cited by examiner

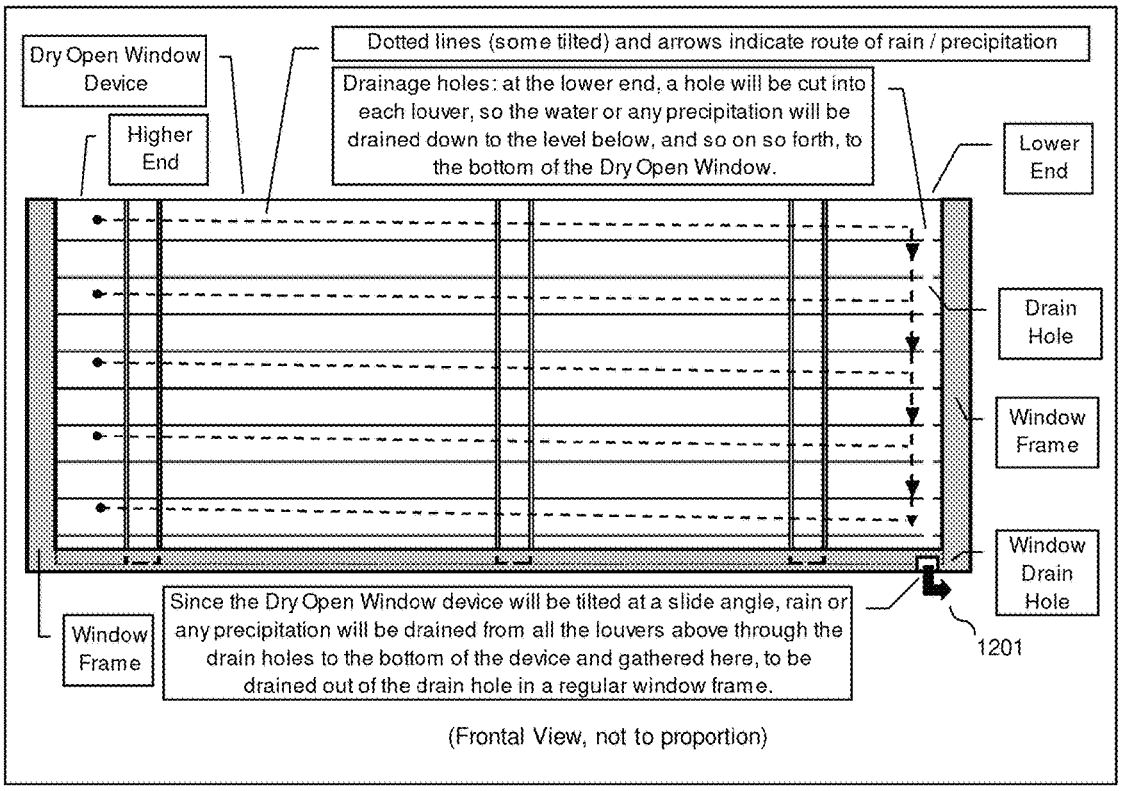
Figure 12 Drainage System

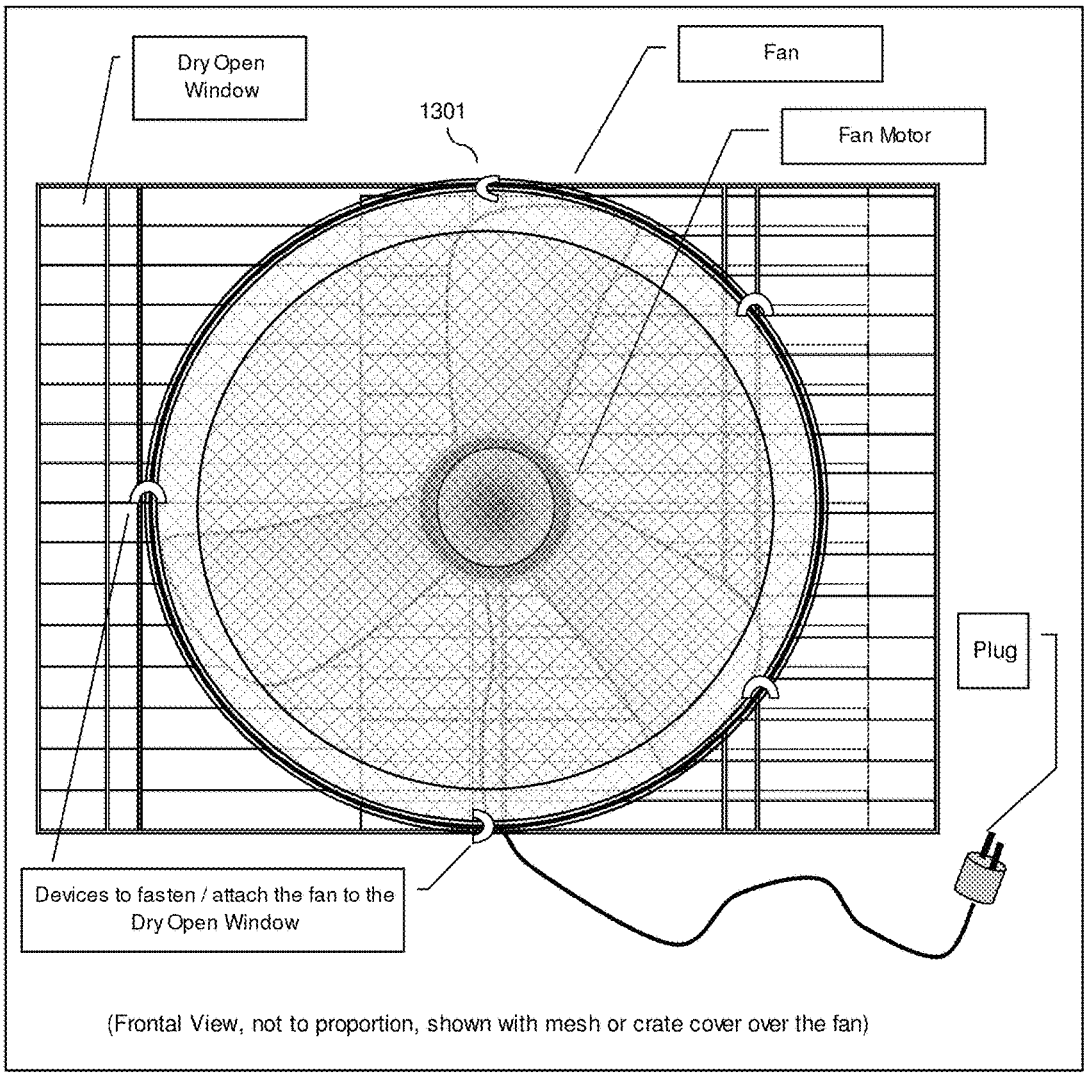
Figure 13 – Dry Window Fan

RECONFIGURABLE SYSTEM ALLOWING AIR FLOW THROUGH AN OPEN WINDOW WHILE BLOCKING PRECIPITATION

CROSS-REFERENCE TO RELATED APPLICATIONS

This application claims the benefit of provisional patent application Ser. No. 61/207,297, filed on Mar. 26, 2009.

FEDERALLY SPONSORED RESEARCH

Not applicable

SEQUENCE LISTING OR PROGRAM

Not applicable

BACKGROUND OF THE INVENTION

1. Field of Invention

This invention relates to devices that are used to let fresh air in or through a window or opening but at the same time keep rain or any other kind of precipitation out. This is a device that will enable people to keep a window or an opening open even in inclement weather or when precipitation of any kind threatens to enter the opening or window. This is a device that will also save energy as it will significantly decrease the use of air conditioning in homes, offices, or any other space.

2. Background of the Invention:

In days and nights when windows are open for fresh and cool air to flow into or through a building from outside the building, the open windows will not prevent rain from coming inside when rain is blown in by any amount of wind. An open window is an invitation for flooding on any rainy day, especially during a windy thunderstorm. Therefore one cannot leave an open window unattended during the day when it may rain. During the evening, if a window is open to let in fresh cool air, when it starts to rain during the night, one will have to suffer the inconvenience of waking up, going to the open window now soaked in rain closing the window, drying up the wet spot on the floor, and then trying to go back to sleep, which interrupts a good night's sleep, not to mention damaging the property around or below the window.

The alternative to the open window is most likely a closed window, which in hot weather necessitates the operation of an air-conditioning system. Or, without air conditioning, one would have to suffer the heat and suffocation in a close-off building or space. As energy becomes more and more expensive and the world becomes more environmentally conscious, more and more people would like to have an open window to let the air flow through their residences or businesses. Yet, inclement weather makes the open window a liability, an inconvenience, a hassle, and sometimes an impossibility.

All this points to the need for a device that will let the air flow through an open window into a building, but at the same time keep the rain out in inclement weather or any kind of precipitation from being blown into an opening.

BACKGROUND OF THE INVENTION

Objects and Advantages

Presently, there is no device that lets air in or through a building or structure and keeps the rain out at the same time.

Although louvered windows have existed for a long time and are used in some houses in certain regions far south where the weather is mild, they cannot keep rain out when there is a steady wind, thus making them prone to flooding.

Besides the louvered glass windows, there is no device I have seen in the market place that can perform the dual function of letting fresh air in or through a building or structure while keeping rain out in inclement weather.

Therefore, I have invented a device that will let fresh air into a building or structure while keeping the rain out at wind speeds up to a certain limit.

Furthermore, I have invented a device in which a fan will be added to the dry open window device, to further enhance the flow of the air from outside but will keep the rain out at the same time at wind speeds up to a predetermined limit.

Both devices are further described in detail below.

SUMMARY

There shall be two separate devices in this invention:

1. The Dry Open Window

The Dry Open Window is a device that will sit in an open window or any opening, secured against the window frame or the frame of the opening, to let the air through the window or opening, but at the same time to keep rain drops or any other precipitation from entering the window or opening even though the rain drops or precipitation may be forced towards the window or opening, as by a wind or any other air movement.

2. The Dry Window Fan

The Dry Window Fan is a device that works in conjunction with the Dry Open Window, has all the functions of the Dry Open Window, but has a mechanized fan attached to it, most likely driven by electricity, to increase the air flow through the window or the opening in either direction, but to keep rain drops or any other precipitation from entering the window or opening.

BRIEF DESCRIPTION OF THE DRAWINGS

FIG. 12 demonstrates how the drainage system works to lead precipitation gathered in the device to exit outside the window.

FIG. 13 demonstrates the Dry Window Fan device, where a fan is attached to the Dry Open Window to increase the air flow, but keep the precipitation out at the same time.

DETAILED DESCRIPTION

Each of the two devices will be detailed below regarding their function, their design, and their features.

1. The Dry Open Window
   - I. The Function
     - i. The Dry Open Window (DOW) will let air flow through this device into a building or structure or any enclosure when it is placed in an open window or any opening.
     - ii. The DOW will not let rain or any other precipitation go through the device at wind speeds up to a predetermined wind speed limit.
     - iii. The DOW will be made child proof for safety.
     - iv. The DOW will be secure, so that it is not easily pushed out of the window frame or the frame of the opening by strong winds or accidental light human force.
   - II. The Design
     - i. The louvers and their functions: There will be various shapes of louvers to be employed in this device, as they may function differently for different purposes at different wind speeds. Wind tunnel tests will be conducted to select the best shape for the best function to let air in but stop the rain or any precipitation in varying situations and for different purposes. Below are some examples of possible louvers, but not limited to them.

Figure 1:
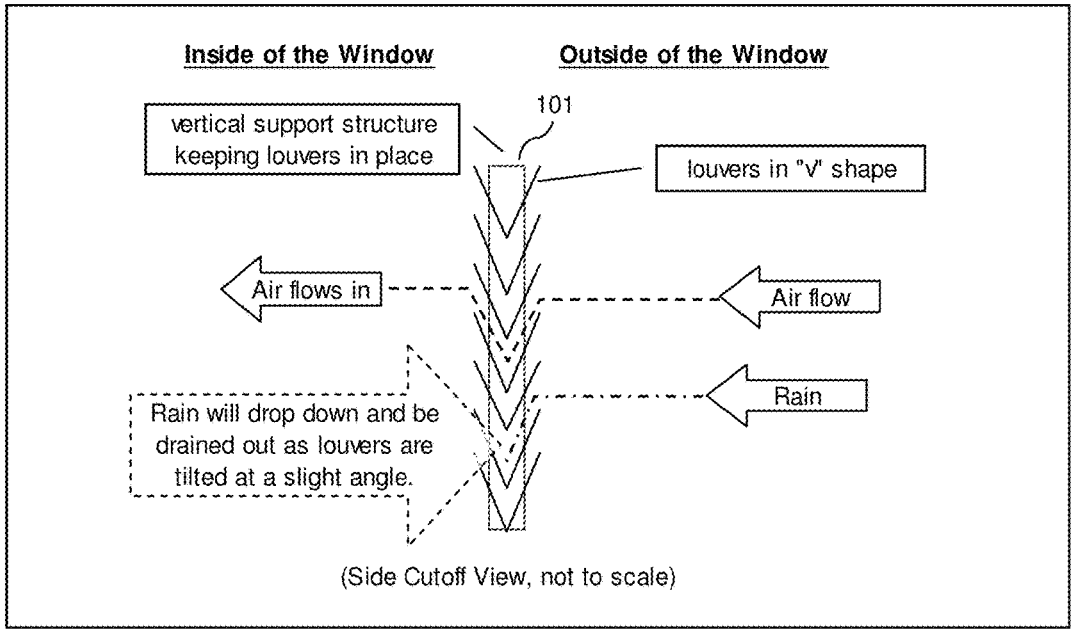
FIG. 1 is an illustration demonstrating how the invention with "V"-shaped louvers lets air flow from outside a window through the device into a living space while keeping precipitation out.

A. Dry Open Window (DOW) with "V"-Shaped Louvers (FIG. 1):
   - a. The shapes of the louvers will be like a "V" individually from a cross-sectional view.
   - b. They are placed in a fixed position, as supported by vertical support structures, shown in FIG. 1 at 101, overlapping each other, as shown in FIG. 1.
   - c. The overlapping arrangement of these louvers will let air flow through, but stop the rain at various wind speeds up to a predetermined not-to-exceed wind speed. When rain drops hit the outside of the louvers, they will either bounce off them and fall outside the device or will drop down to the bottom of the "V"-shaped louvers, as shown in FIG. 1. The louvers can be positioned at a degree as determined by lab tests to ensure that rain will not be blown in at wind speeds up to a predetermined not-to-exceed wind speed.
   - d. The rain collected at the bottom of the "V"-shaped louvers will drain outside the window, as the louvers will be slightly tilted at a predetermined appropriate angle. The rain will follow the normal drainage route of a regular window.

Figure 2:
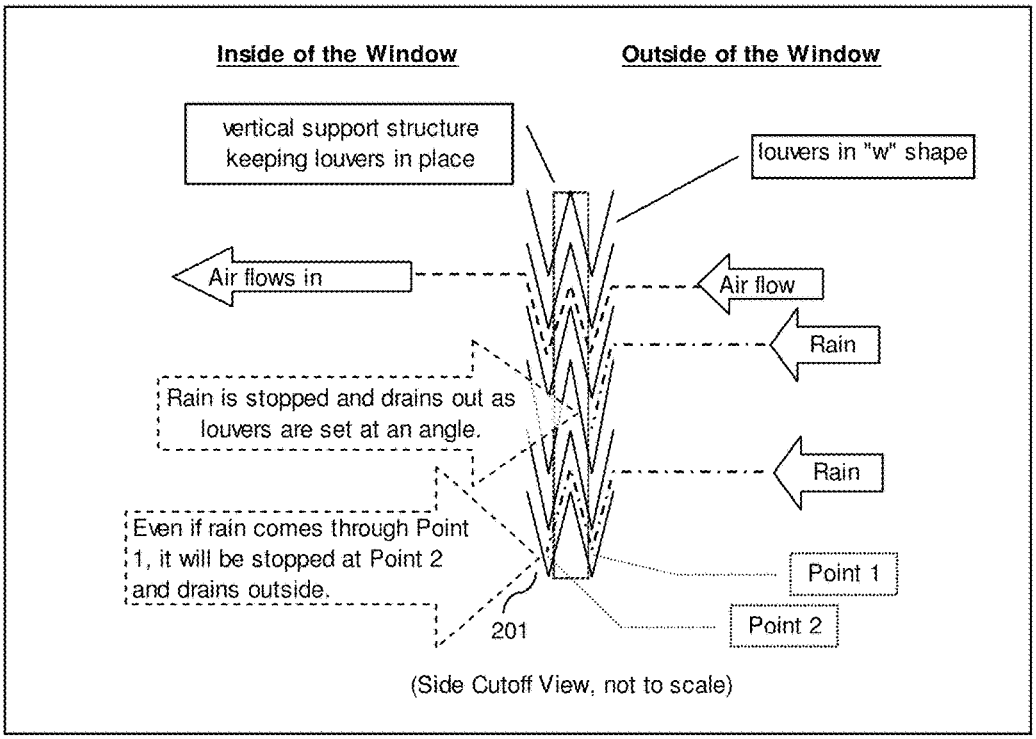
FIG. 2 is an illustration demonstrating how the invention with "W"-shaped louvers lets air flow from outside a window through the device into a living space while keeping precipitation out.

B. Dry Open Window (DOW) with "W"-Shaped Louvers (FIG. 2):
   - a. The shapes of the louvers will be like a "W" individually from a cross-sectional view.
   - b. They are placed in a fixed position, as supported by vertical support structures, overlapping each other.
   - c. The overlapping arrangement of these louvers will let air flow through, but stop the rain at wind speeds of up to a predetermined not-to-exceed wind speed. When rain drops hit the outside of the louvers, either they will bounce off them and fall outside the device or they will drop down to the bottom of the "W"-shaped louvers.
   - d. The "W"-shaped louvers will function better than the "V"-shaped louvers as they provide a second line of defense, as shown in FIG. 2, because when rain drops are somehow blown in from the first bend in the louvers, they will be stopped by the second bend in the louvers, as shown in FIG. 2 at 201. Tests will be conducted to ensure that rain will not be blown in at wind speeds up to a predetermined not-to-exceed wind speed.
   - e. The rain collected at the bottom of the "W"-shaped louvers will drain outside the window, as the louvers will be slightly tilted at an angle. The rain will follow the normal drainage route of a regular window.

Figure 3:
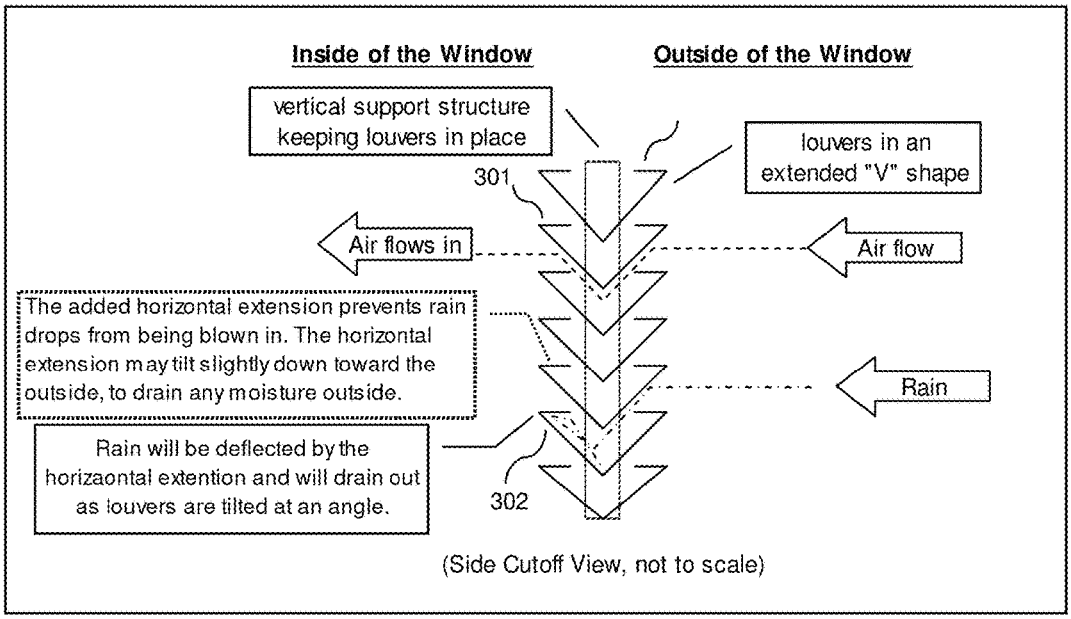
FIG. 3 is an illustration demonstrating how the invention lets air flow from outside a window through the device into a living space while keeping precipitation out by using "V"-shaped louvers that have a little horizontal edge at the top of the V shapes to further prevent precipitation from entering the space inside the window from outside the window.
Figure 4:
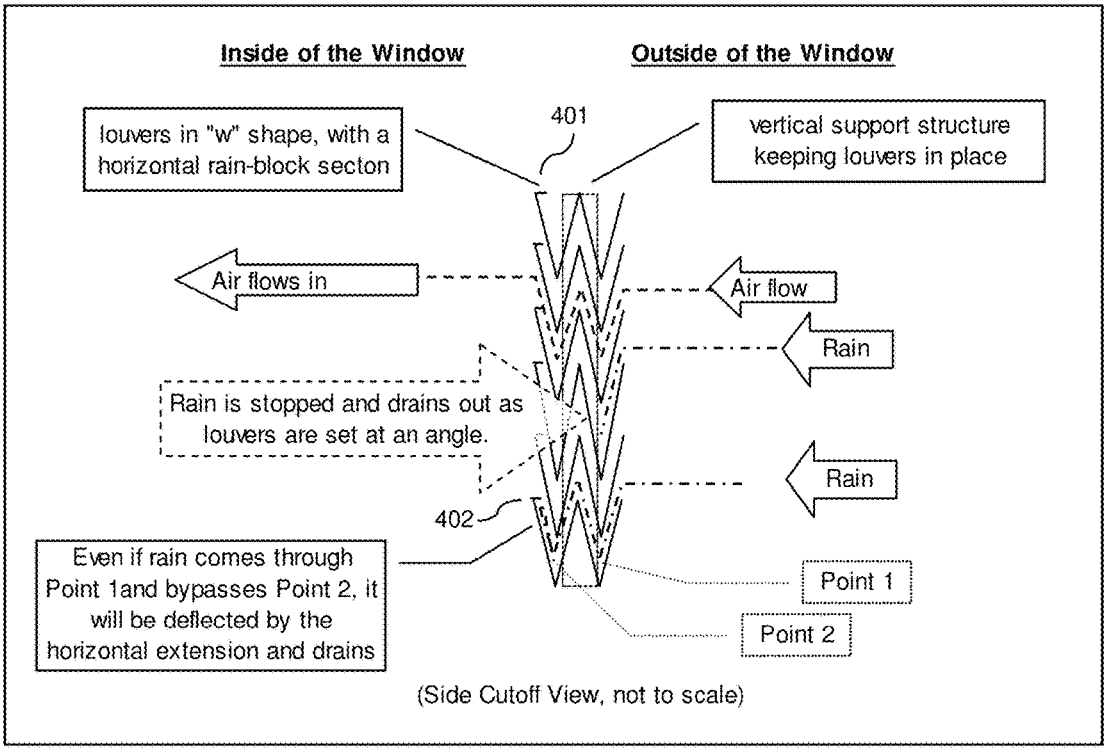
FIG. 4 is an illustration demonstrating how the invention lets air flow from outside a window through the device into a living space while keeping precipitation out by using "W"-shaped louvers that have a little horizontal edge at the top of the inside edge of the W shapes to further prevent precipitation from entering the space inside the window from outside the window.
Figure 5A:
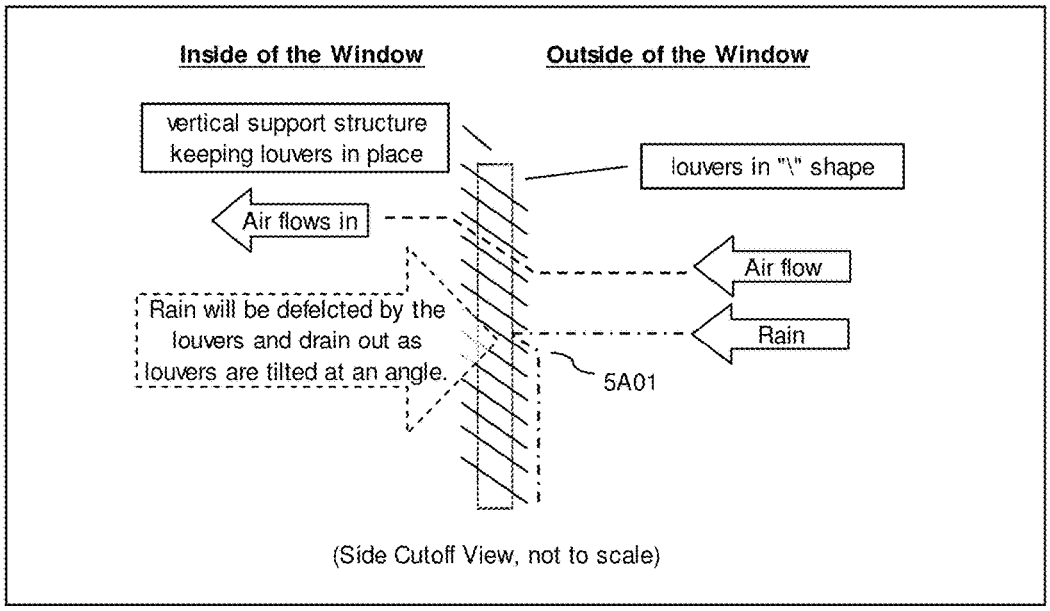
FIG. 5*a* is an illustration demonstrating how the invention lets air flow from outside a window through the device into a living space while keeping precipitation out by using "\"-shaped louvers.
Figure 5B:
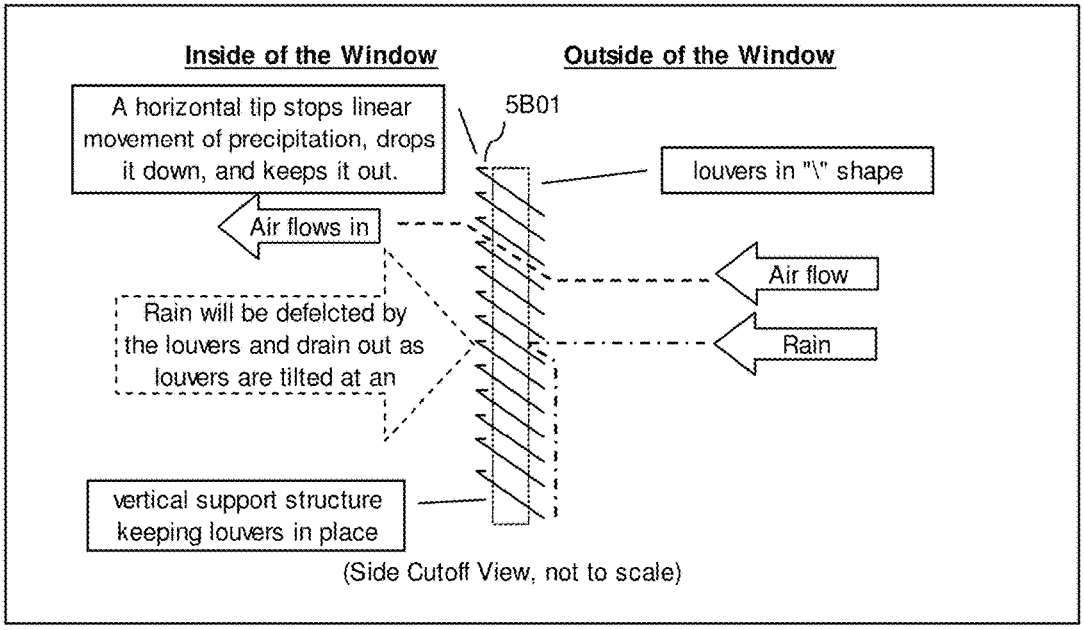
FIG. 5*b* is an illustration demonstrating how the invention lets air flow from outside a window through the device into a living space while keeping precipitation out by using "\"-shaped louvers that have a little horizontal edge at the top of the inside edge of the "\" shapes to further prevent precipitation from entering the space inside the window from outside the window.
Figure 6:
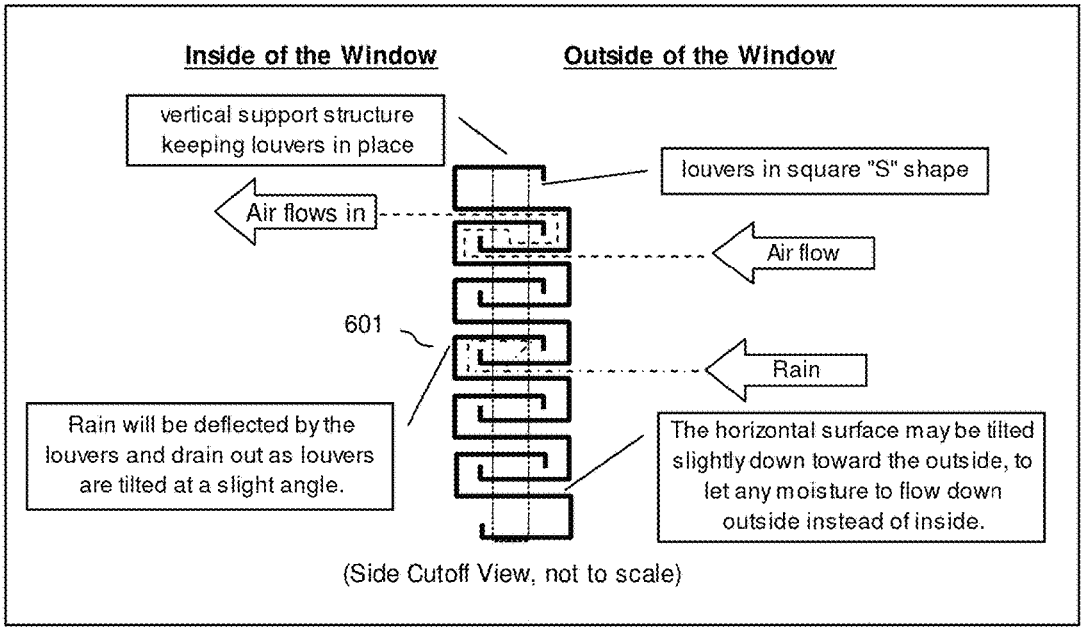
FIG. 6 is an illustration demonstrating how the invention with square "S"-shaped louvers lets air flow from outside a window through the device into a living space while keeping precipitation out.

C. Dry Open Window (DOW) with Louvers of Various Other Shapes:
   - a. The shape of the louvers is similar to the "V" shape, as shown in FIG. 3, but there is a horizontal extension at the end of each louver, as shown in FIG. 3 at 301. The main purpose is that the horizontal extension will stop rain or precipitation from being blown in, as shown in FIG. 3 at 302. Wind tunnel tests will be conducted to test the robustness of louvers of this shape in the DOW invention.
   - b. The shape shown in FIG. 4 is similar to the "W" shape, but there is a horizontal extension at the end of each, as shown in FIG. 4 at 401. The main purpose is that the horizontal extension will stop rain or precipitation from being blown in, as shown in FIG. 4 at 402. Wind tunnel tests will be conducted to test the robustness of louvers of this shape in the DOW invention.

c. The shape shown in FIG. 5*a* is a "\" shape, which may seem simple, but may just serve the same purpose, as rain will be stopped and slide down, as shown in FIG. 5*a* at 5A01. In this design, there may not even be any need for a drainage feature, as all rain drops will fall outside the invented device and thus outside the window, to be drained away as precipitation would be in regular windows. Wind tunnel tests can be conducted to test the robustness of louvers of this shape in the DOW invention, as the angle and the length of the louvers will need to be determined for optimal rain deflection. The advantage of the DOW with this kind of louvers is that louvers may be made to be flexible and moveable, so that when wind speeds go to a certain level, the louvers will tilt at a sharper angle, thus making it more difficult for precipitation drops to be blown inside by stronger winds. An additional horizontal tip may be added to the top of the "\" shape so that even when precipitation is whipped up from the outside, the horizontal tip will function as a deflector, stopping the linear movement of the precipitation, preventing the precipitation from being blown in, and will then guide the precipitation to drip down to the collecting groove to be drained out, as shown in FIG. 5*b* at 5B01.

d. The shape shown in FIG. 6 is a square "S" shape, which may be the optimal shape to keep the precipitation out but let air in. Due to the complex shape and the many bends, rain has no chance of getting in at wind speeds up to a predetermined not-to-exceed wind speed, as shown in FIG. 6 at 601. Wind tunnel tests can be conducted to test the robustness of louvers of this shape in the DOW invention.

e. Other shapes will be tested out for the most desired effect of letting air in and keeping precipitation out of a window or an opening.

Figure 7:
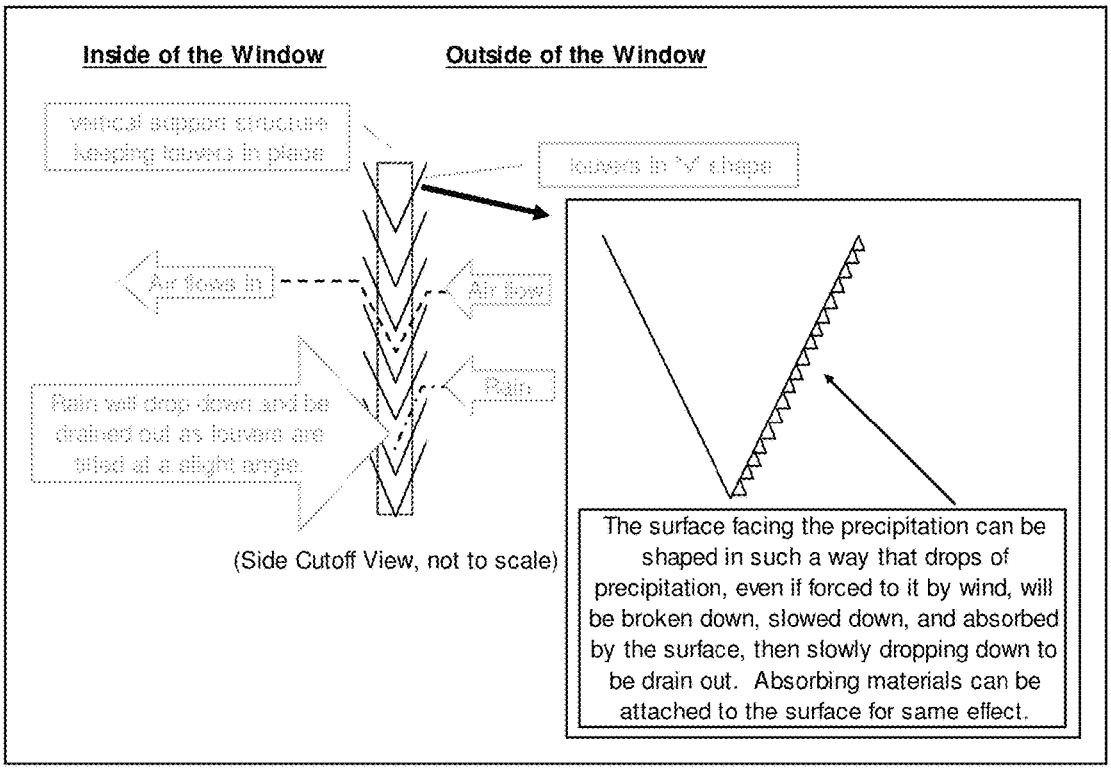
FIG. 7 is an illustration demonstrating how the "V"-shaped louvers can be enhanced with a surface that is not smooth to further enhance the capability of the "V"-shaped louvers to let air flow from outside a window through the device into a living space while keeping precipitation out.

D. Materials to be used:

a. The basic material for DOW can be clear plastic, but the clear plastic can also be tinted in different colors as choices for customers. Some DOW can also be made of materials with opaque colors, so DOW will not be transparent entirely. The opaqueness will provide privacy.

b. The materials used to make the device can be turned either clear or opaque by the flip of a switch, so it is transparent if desired or opaque if needed.

c. For security reasons, some DOW can be made of metal, as an added security feature to satisfy the needs of some customers.

d. Security features, such as the locking devices to be described later, may use other materials, as is necessary for security.

e. The materials used to make the device can be plastic, glass, metal, wood, bamboo, or any other durable material suitable for the manufacturing process.

f. The louver surface facing the precipitation can be shaped in such a way that drops of precipitation, even if forced to it by wind, will be broken down, slowed down, and absorbed by the surface, then slowly dropping down to be drain out. Absorbing materials can be attached to the surface for same effect. See FIG. 7 for illustration.

ii. The vertical support that keeps the louvers in place:

A. The vertical support can be two to three pieces. They are attached to the louvers, so that the vertical support pieces will keep the louvers secure at predetermined spaces. They can be made of clear plastic or metal or glass materials or any other material, and they can have tints of various colors, and they can be opaque with various colors.

B. There will be various means to attach the louvers to the vertical support pieces. They can be snapped in place by customers, which will enable easy packaging. But they can be fixed at the plant in the manufacturing process by screws, molding, or locking devices, or whatever method.

iii. The sliding function for proper fitting into different sizes of windows and openings:

A. The sliding function:

The sliding function is to enable the Dry Open Window device to fit properly into windows or openings of various sizes. This is achieved by making a section of the louvers moveable, to slide either horizontally or vertically, so the device can extend horizontally and vertically.

Figure 8:
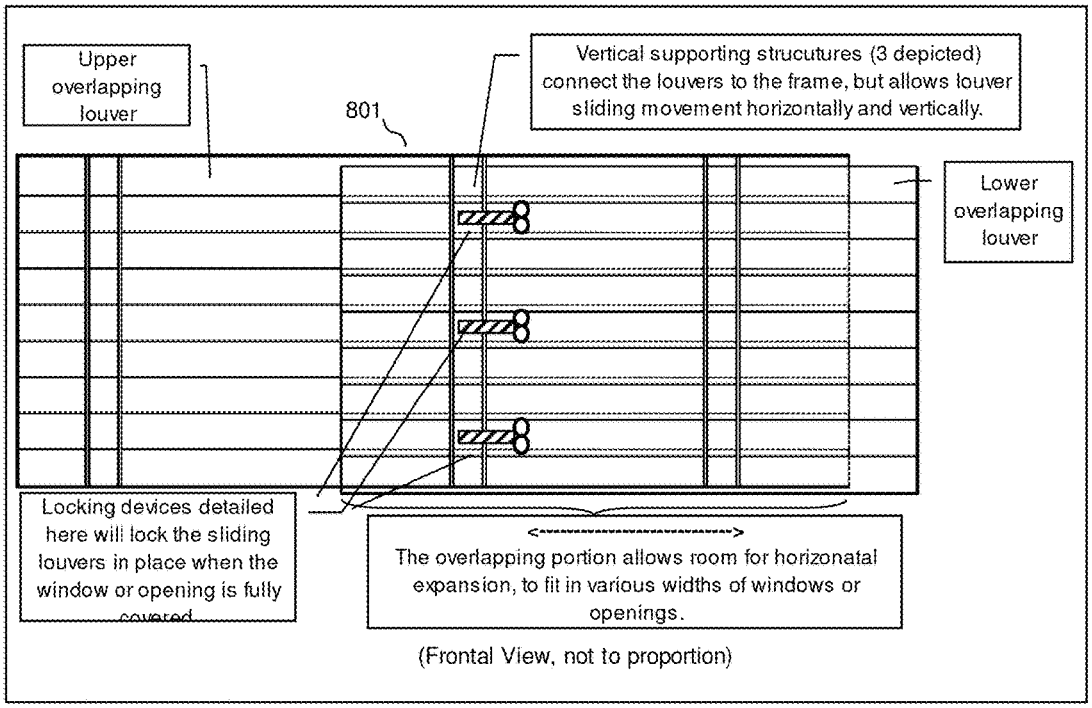
FIG. 8 demonstrates the slide features of the "V"-shaped louvers, so that the device can easily fit in the space of windows of various widths and fully enclose the space of the open window width.

B. The sliding pieces:

Horizontal Sliding Function: At one end of the device, a separate set of louvers will overlap another set of louvers for a certain length so the device can extend to fit a window or opening of varying widths, as shown in FIG. 8 at 801.

Figure 9A:
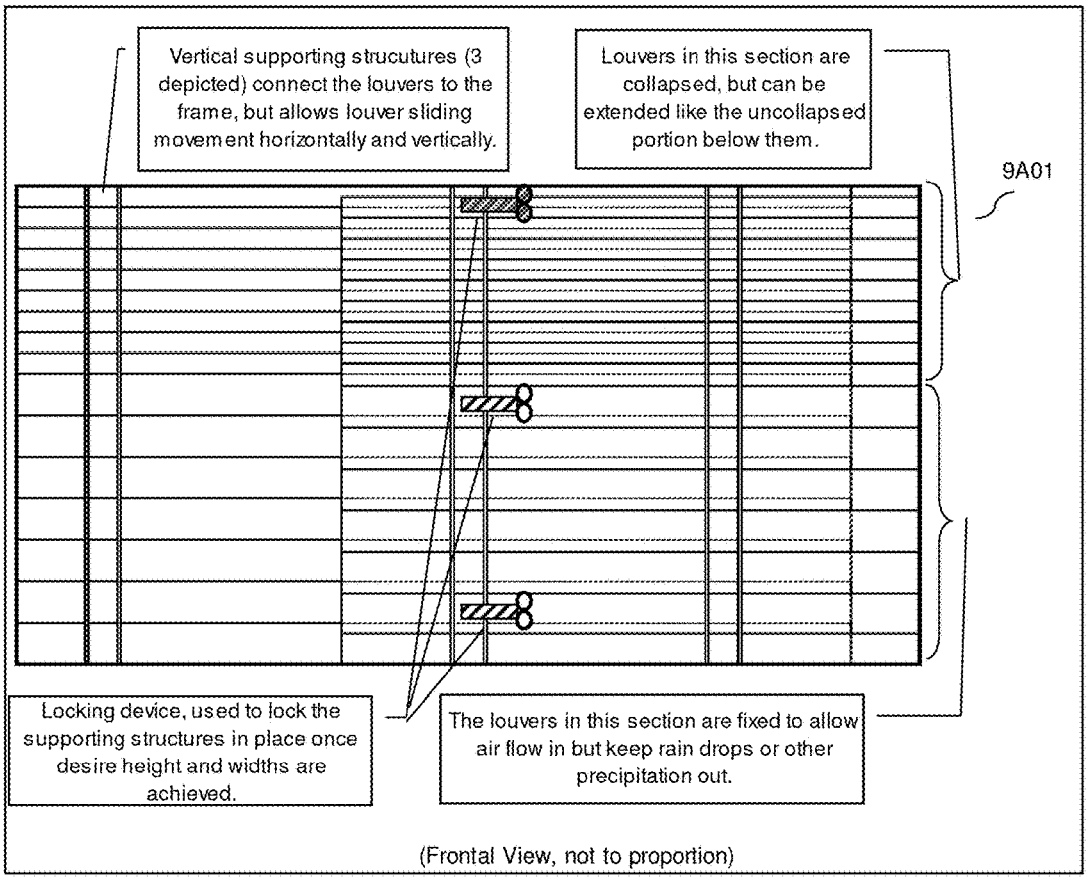
FIG. 9*a* demonstrates the collapsed state of the collapsible feature of the "V"-shaped louvers. When collapsed, this feature allows the device to narrow the space to let air through the device from outside the window.
Figure 9B:
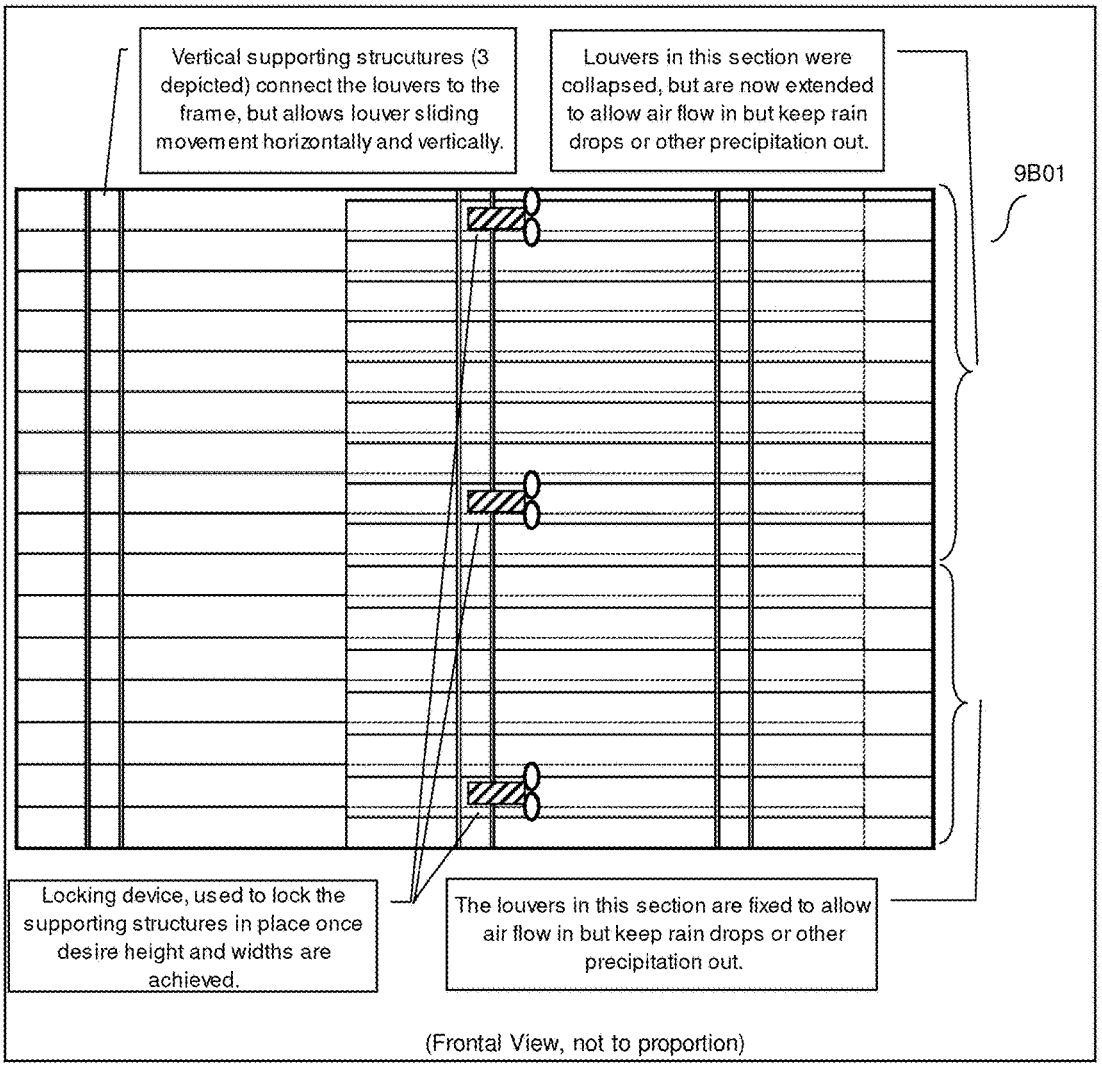
FIG. 9*b* demonstrates the extended state of the collapsible feature of the "V"-shaped louvers. When extended, this feature allows the device to increase the space to let air through the device from outside the window.

Vertical Sliding Function: At the top of the device, some louvers are stacked close upon each other, but can be extended when the vertical supports slide to extend the height of the device, as shown in FIG. 9*a* at 9A01. When the vertical overlapping support pieces are extended upward to a desired height, they will take the collapsed louvers upward and open them up, space them like the fixed louvers at the bottom of the device, as shown in FIG. 9B at 9B01, thus enabling the device to fit in windows or opening of varying heights, as shown in FIGS. 9*a* and 9*b*.

Figure 10:
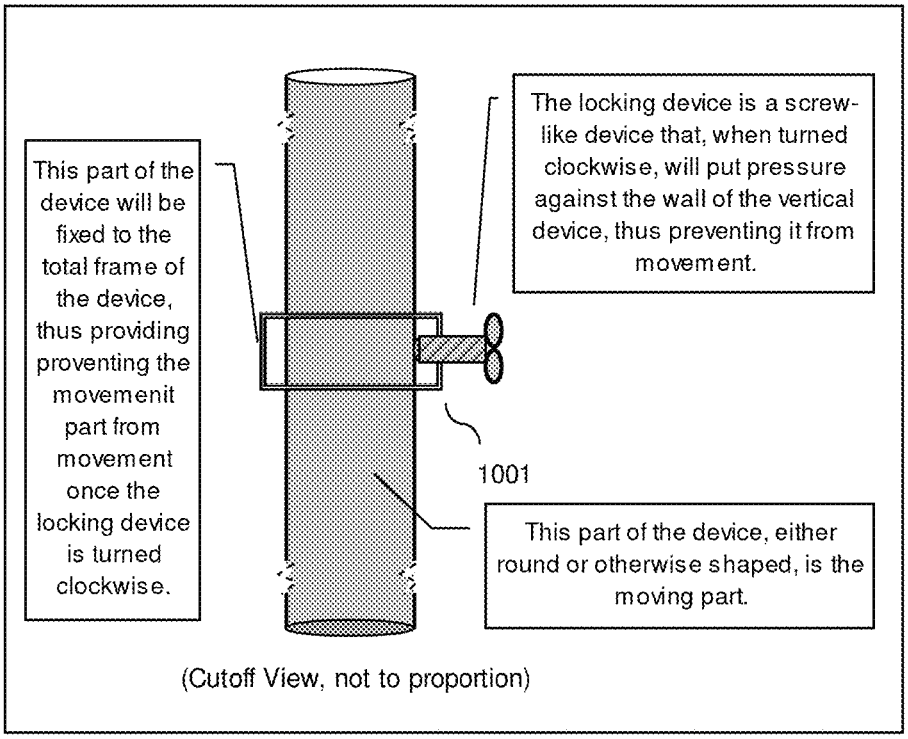
FIG. 10 demonstrates the rod-like device that is used to fit between the top of the sliding part of a window and the top of the window frame; when in place, it will stop the moveable part of the window from moving, thus fixing it and the Dry Open Window or Dry Window Fan in place.
Figure 11:
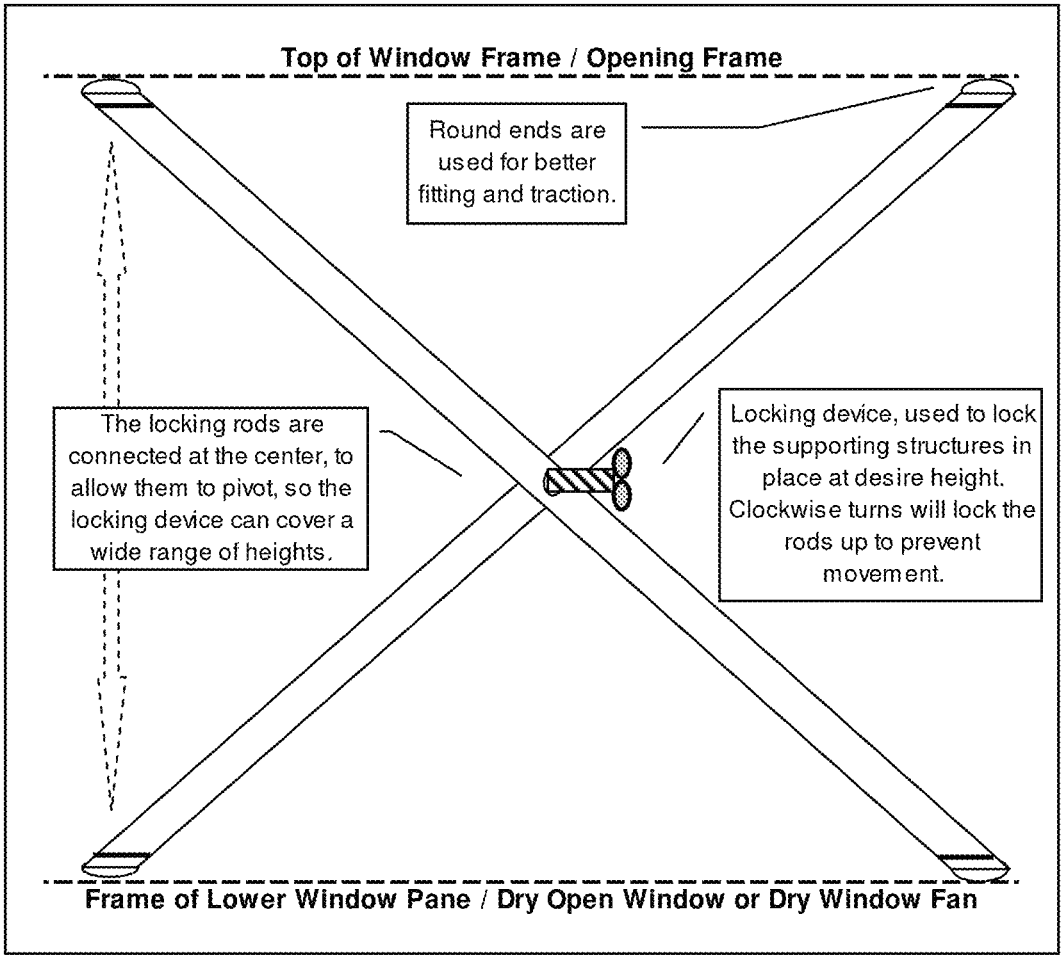
FIG. 11 is an alternative device, in X-shape, that is used to fit between the top of the sliding part of a window and the top of the window frame; when in place, it will stop the moveable part of the window from moving, thus fixing it and the Dry Open Window or Dry Window Fan in place.

C. The locking device:

The sliding parts of the device will have a locking device to fix the device at the desired height or width. The locking device will function the same way for both the vertical and horizontal sliding parts by putting a moving part inside a fixed part, where a screw-like device will thread itself through the fixed part and putting pressure against the wall of the moving part, thus preventing the moving parts from movement and locking up the parts together, as shown in FIG. 10 at 1001.

iv. The Vertical Locking Device: This device is designed to prevent the DOW or DWF from vertical movement in the window or opening, thus locking it in place, preventing it from being moved by the wind or accidentally by a small child. This is achieved with two poles connected in the center, allowing them to pivot, so the locking device can lock up in a wide range of heights. A locking device will lock the two rods in place to prevent the two poles from moving, once the poles are securely placed dry open window or dry window fan device. The lock shall be made child-proof. The locking device is described and shown in detail in FIG. 11.

v. The drainage system:

A. The drainage is enabled by the angle of the louvers, which are tilted at a slight angle to let gravity lead the water through the proper drainage route, as shown in FIG. 12.

B. The proper angle can be determined through lab tests, to ensure proper drainage at the proper angle for given amounts of precipitation collected by the louvers.

C. The water draining out of the louvers will be led to the existing drain hole in the window frame, which will then flow outside the building, as shown in FIG. 12 at 1201.

vi. Electronic sensors to automatically adjust louver angles and movements:

A. For some of the louver designs, an electronic sensor is built into the device, so that when wind speeds go up, the electronic sensor will send a signal to a mechanism to adjust the angle of the louvers to predetermined angles relevant to wind speed, thus narrowing the gap between louvers at higher wind speeds, which then decreases the chance of rain drops or any precipitation entering a space from outside the space.

B. Wind tunnel tests will determine the angle, the movement span, the materials to be used, the electronic sensor setting, and the proper functions of the adjustment louvers.

C. The electronic sensor will be developed in accordance with the wind tunnel tests.

D. The movement will be made noiseless, enabling nighttime use without disturbing sleep.

vii. Possible mechanical louver self-adjustment driven by wind speed:

A. For some of the louver designs, it is possible to keep the louvers adjustable, so that when wind speeds go up, the wind strength will then move the louvers to a predetermined angle, thus narrowing the gap between louvers, which then decreases the chance of rain drops or any precipitation entering a space from outside the space.

B. Wind tunnel tests will determine the angle, the movement span, the materials to be used, and the proper functions of the adjustment louvers.

C. The movement will be made noiseless, enabling nighttime use without disturbing sleep.

2. The Dry Window Fan

The Dry Window Fan (DWF) will have all the same features as found in the Dry Open Window and will also have a fan, which can be driven by electricity, attached to the Dry Open Window device.

The fan can be driven by a power source other than electricity.

The fan will be attached to the Dry Open Window device by a variety of devices, such as nuts and bolts, hooks, latches, or any other device, as in FIG. 13 at 1301. The fan and the Dry Open Window can also be molded into one piece.

The fan will have a switch that can reverse the direction of the fan blade rotation, thus enabling airflow to go in either direction, letting air flow into or outside the window or opening, where the Dry Window Fan will be placed.

There will be a device, as an option, that is attached to the front of the fan to direct the air flow in a desired direction. The device can rotate 360° degrees so that the direction of the airflow can vary in various directions instead of in a fixed direction.

The fan will have variable speeds.

The fan will be water resistant.

The fan will have, as an option, a wind speed sensor that will either slow down the fan speed or shut itself down as external wind speed increases.

The fan will have a safety feature that will immediately shut itself down and stop the fan blades from turning, to avoid injuries, if the sensor detects contact between the fan blades and another object.

The fan will have a protective crate or casing or mesh or any other protective device all around it, to prevent any finger being inserted into the path of the fan blades.

The fan will have, as an option, a whistling device that will sound the alarm when it detects the external wind speed to exceed a preset limit, thus giving a warning about dangerous weather conditions. The whistling device can be turned off manually. The whistling device cannot be turned off at a predetermined wind speed, so that it serves as a warning to residents that the device cannot be used when wind speed exceeds that predetermined limit. The instructions on the device will ask residents to remove the device and close the window or opening when the whistling cannot be turned off.

The fan blades and their casing and protective crate can be made of clear plastic, to allow light in. Or they can be made of opaque materials for privacy.

Although the invention has been described in detail in the foregoing embodiment for the purpose of illustration, it is to be understood that such detail is solely for that purpose and that variations can be made therein by those skilled in the art without departing from the spirit and scope of the invention except as it may be described by the following claims.

I claim:

1. An environmental window apparatus, comprising:

a dry open window (DOW) structure having a plurality of composite louvers, each with opposing ends, each of the composite louvers constructed from a pair of at least partially overlapping louver portions, each of the louver portions of each of the composite louvers, when viewed in cross section, being formed in the shape of a "V" or "W" that enable air to pass through a window opening while limiting passage of precipitation, the "V" shape disposed with a narrower end pointed downward and two portions sloping upwardly therefrom or the "W" shape disposed with two narrower ends of the shape pointed downward and two portions sloping upwardly from each of the narrower ends such that the precipitation instead is captured by the louvers for collection or drainage;

a plurality of vertical members supporting the composite louvers in a vertically spaced apart arrangement in a vertical stack between generally parallel interior and exterior planes;

wherein a width of the dry open window structure being adjustable by moving the louver portions of each composite louver toward or away from each other to vary the amount of overlap, and wherein the geometry of the "V" or "W" shaped louver portions and the vertically spaced apart arrangement being such that no line can be drawn through the interior and exterior planes without intersection one of the louver portions.

2. The environmental window apparatus of claim 1, wherein each of the "V" or "W" shaped louver portions are symmetrical about a central plane between the interior and exterior planes.

3. The environmental window apparatus of claim 1, wherein the plurality of vertical members includes a central support member supporting the louver portions where they overlap.

4. The environmental window apparatus of claim 3, wherein the plurality of vertical members further includes a first side support member and a second side support member spaced from the central support member.

5. The environmental window apparatus of claim 1, wherein the opposing ends of the composite louvers include drain holes.

6. The environmental window apparatus of claim 1, wherein the opposing ends of the composite louvers are tapered to fit into vertical grooves of an existing window jam.

7. The environmental window apparatus of claim 1, wherein the apparatus includes a plurality of the dry open window structures stacked vertically on top of one another to fit window openings of different heights.

8. The environmental window apparatus of claim 1, further comprising a locking mechanism to prevent the sliding of the at least partially overlapping louver portions once a desired overall width of the structure is achieved.

9. The environmental window apparatus of claim 1, further comprising an electrical fan coupled to an insert to blow or draw air through the insert.

10. The environmental window apparatus of claim 1, wherein the composite louvers are opaque.

11. An environmental window apparatus, comprising:

a dry open window (DOW) structure having a plurality of composite louvers, each with opposing ends, each of the composite louvers constructed from a pair of at least partially overlapping louver portions, each of the louver portions of each of the composite louvers, when viewed in cross section, being formed in the shape of a "V" or "W" that enable air to pass through a window opening while limiting passage of precipitation, the "V" shape disposed with a narrower end pointed downward and two portions sloping upwardly therefrom or the "W" shape disposed with two narrower ends of the shape pointed downward and two portions sloping upwardly from each of the narrower ends such that the precipitation instead is captured by the louvers for collection or drainage;

a plurality of vertical members supporting the composite louvers in a vertically spaced apart arrangement;

wherein a width of the dry open window structure being adjustable by moving the louver portions of each composite louver toward or away from each other to vary the amount of overlap, wherein the composite louvers are transparent.

12. The environmental window apparatus of claim 1, wherein the composite louvers each have opposing outer surfaces with lengthwise grooves or serrations.

* * * * *